US009714123B2

(12) United States Patent
Agassi et al.

(10) Patent No.: US 9,714,123 B2
(45) **Date of Patent: *Jul. 25, 2017**

(54) DISPENSING CLOSURE

(71) Applicant: Agam Innovations Ltd., Netanya (IL)

(72) Inventors: Or Agassi, Tel Aviv (IL); Reuven Marko, Netanya (IL)

(73) Assignee: Agam Innovations Ltd., Netanya (IL)

( * ) Notice: Subject to any disclaimer, the term of this patent is extended or adjusted under 35 U.S.C. 154(b) by 20 days.

This patent is subject to a terminal disclaimer.

(21) Appl. No.: 14/691,004

(22) Filed: Apr. 20, 2015

(65) Prior Publication Data

US 2015/0225142 A1 Aug. 13, 2015

Related U.S. Application Data

(63) Continuation-in-part of application No. 14/589,596, filed on Jan. 5, 2015, which is a continuation of (Continued)

(51) Int. Cl.
*B67D 1/00* (2006.01)
*B65D 47/12* (2006.01)
(Continued)

(52) U.S. Cl.
CPC ..... *B65D 47/12* (2013.01); *B65D 47/265* (2013.01); *B65D 47/32* (2013.01); *B65D 51/226* (2013.01)

(58) Field of Classification Search
CPC ..... B65D 47/12; B65D 47/265; B65D 47/32; B65D 51/226
(Continued)

(56) References Cited

U.S. PATENT DOCUMENTS 2,112,125 A 3/1938 Bruno
2,163,555 A * 6/1939 Geyer ..... B01L 3/10 215/307
(Continued)

FOREIGN PATENT DOCUMENTS

WO 2014027341 A1 2/2014

OTHER PUBLICATIONS

International Search Authority: "Written Opinion of the International Searching Authority" (PCT Rule 43bis.1) including International Search Report for International Patent Application No. PCT/IL 11/00783; Date of Mailing: May 4, 2012.
(Continued)

*Primary Examiner* — Patrick M Buechner
*Assistant Examiner* — Jeremy W Carroll
(74) *Attorney, Agent, or Firm* — M&B IP Analysts, LLC

(57) ABSTRACT

A dispensing closure for covering an opening of a container including a liquid is presented. The dispensing closure includes an engagement element that fits over the opening of the container and defines a pouring orifice for allowing pouring of the liquid. The pouring orifice having a side defining an air channel for allowing air to flow into the container when liquid during the pouring. The engagement element also includes outer walls and a cap having a hollow including inner walls tightly conforming to the outer walls, a first orifice generally conforming in shape to the pouring orifice, and a second orifice generally conforming in shape to the air channel.

7 Claims, 1 Drawing Sheet

Related U.S. Application Data application No. 13/252,345, filed on Oct. 4, 2011, now Pat. No. 8,944,297, which is a continuation of application No. 29/394,407, filed on Jun. 16, 2011, now Pat. No. Des. 678,768.

(60) Provisional application No. 61/982,338, filed on Apr. 22, 2014, provisional application No. 61/391,101, filed on Oct. 8, 2010.

(51) Int. Cl.
*B65D 47/32* (2006.01)
*B65D 51/22* (2006.01)
*B65D 47/26* (2006.01)

(58) Field of Classification Search
USPC ..... 222/153.14, 478, 479, 481, 481.5, 482, 222/483–487, 548–555
See application file for complete search history.

(56) References Cited

U.S. PATENT DOCUMENTS 2,642,207 A 6/1953 Saverio
2,717,727 A * 9/1955 Robb ..... B65D 47/261 222/212
2,968,423 A 1/1961 Mahler et al.
3,198,406 A * 8/1965 Kopelman ..... B65D 47/261 222/545
3,263,871 A 8/1966 Thompson
3,317,093 A * 5/1967 Moran ..... B65D 47/24 222/484
D217,330 S 4/1970 Conry
3,630,419 A 12/1971 Pierce
3,750,915 A 8/1973 Kearney
D229,826 S 1/1974 Raptis
3,796,348 A 3/1974 Zipper
3,894,661 A 7/1975 Guala
3,966,099 A 6/1976 Sanford, Jr. et al.
4,010,875 A 3/1977 Babiol
4,105,141 A 8/1978 Lane et al.
4,171,749 A 10/1979 Aichinger et al.
4,217,988 A 8/1980 Curtis et al.
4,261,484 A 4/1981 DaCosta et al.
4,311,259 A 1/1982 Babiol
4,376,497 A 3/1983 Mumford
4,384,662 A 5/1983 Boudin et al.
4,427,138 A 1/1984 Heinlein
4,497,422 A 2/1985 Klees
4,523,687 A 6/1985 Hullihen
4,597,513 A 7/1986 Schiemann
D285,055 S 8/1986 Heubel
D285,892 S 9/1986 Doyel
4,736,871 A 4/1988 Luciani et al.
4,756,435 A 7/1988 Schick et al.
4,869,399 A 9/1989 Dubach
4,877,159 A 10/1989 Strand
4,884,705 A 12/1989 Debetencourt
4,984,711 A 1/1991 Ellis
5,020,690 A 6/1991 Kishikawa et al.
5,044,530 A 9/1991 Stull
D326,818 S 6/1992 Maguire
5,181,632 A 1/1993 Latter
5,211,318 A 5/1993 Govatzidakis
5,303,839 A 4/1994 Blumenschein
5,303,850 A 4/1994 Connan
5,346,099 A 9/1994 Salmon et al.
5,462,201 A 10/1995 Wilkins
5,713,491 A 2/1998 Hughes et al.
5,785,209 A 7/1998 Guglielmini
5,799,836 A 9/1998 Lee
5,823,383 A 10/1998 Hins
5,960,992 A * 10/1999 Bernstein ..... B65D 5/748 222/541.2
5,961,008 A 10/1999 Peckels
D418,417 S 1/2000 Hollinger
6,016,935 A 1/2000 Huegerich et al.
6,085,949 A 7/2000 Zimny et al.
6,123,225 A 9/2000 Peckels
6,138,849 A 10/2000 Roemer et al.
6,149,022 A 11/2000 Akyildiz et al.
6,315,160 B1 11/2001 Gaiser et al.
6,364,178 B1 4/2002 Paczonay
6,409,054 B1 6/2002 Garibaldi
6,488,186 B2 12/2002 Gaiser et al.
D468,205 S 1/2003 Pierce
6,568,660 B1 5/2003 Flanbaum
D484,801 S 1/2004 Pierce
6,742,678 B1 * 6/2004 Krystopik, Jr. ..... B65D 47/122 215/309
D501,359 S 2/2005 Bodum
6,851,584 B2 2/2005 White
6,851,586 B2 2/2005 Odet
6,883,689 B2 4/2005 Odet
6,892,905 B2 5/2005 Cousseau
D513,180 S 12/2005 Lindsey et al.
7,040,515 B2 5/2006 Cote
D529,799 S 10/2006 Jensen
D533,776 S 12/2006 Allen et al.
7,237,692 B2 7/2007 Bodum
7,300,580 B2 11/2007 Lindsey et al.
7,407,067 B2 8/2008 Kerkhof et al.
D577,997 S 10/2008 Pan
D587,524 S 3/2009 Allen et al.
D587,571 S 3/2009 Gonzales, Jr.
D591,594 S 5/2009 Jalet
7,527,180 B2 5/2009 Allen et al.
7,622,039 B2 11/2009 Farrell et al.
7,806,303 B1 10/2010 Hastings
D633,753 S 3/2011 White
D639,421 S 6/2011 Sano et al.
8,011,540 B1 9/2011 Peckels
D652,251 S 1/2012 Goralski et al.
8,245,882 B1 8/2012 Federighi
8,505,760 B2 * 8/2013 Ott ..... B65D 5/748 215/253
2005/0194410 A1 9/2005 Pham
2006/0000855 A1 1/2006 Allen et al.
2008/0017675 A1 1/2008 Pressey
2008/0073383 A1 3/2008 McDonald
2008/0099514 A1 5/2008 Carter et al.
2008/0237178 A1 10/2008 Laburu
2008/0272147 A1 11/2008 Buker et al.
2009/0008356 A1 1/2009 Gadzic et al.
2010/0006590 A1 * 1/2010 Withoos ..... A61M 35/006 222/1
2010/0038378 A1 2/2010 Gabler et al.
2010/0091605 A1 4/2010 Rasmussen et al.
2010/0230447 A1 9/2010 Eriksen
2011/0024383 A1 2/2011 McKenna et al.
2011/0024453 A1 2/2011 Fleisher
2011/0024925 A1 2/2011 Mauffette
2011/0163119 A1 * 7/2011 Nyambi ..... B65D 51/2835 222/1
2011/0297705 A1 * 12/2011 Albers, Jr. ..... B65D 47/263 222/553

OTHER PUBLICATIONS

Office Action, Japanese Patent Office, Japanese Patent Application No. 2014-503274, Mailing No. 549509, Oct. 21, 2014.
Office Action, State Intellectual Property Office of the P.R.C., Chinese Patent Application No. 201180048571.7, Issue Document No. 2014082800538200, Sep. 2, 2014.
Patent Examination Report No. 1, Australian Patent Application No. 2011371175, Australian Government Patent Office, Sep. 26, 2014.
Technical Examination, Colombian Patent Office, Patent Application in Columbia No. 13-089623, PCT/US2011/025669, Aug. 1, 2014.
Chilean Office Action No. 919-13 for Patent Application in Chile No. 2013-00919, Dated: Dec. 18, 2015, Chilean Patent Office, Chile.

(56) References Cited

OTHER PUBLICATIONS

Foreign Office Action No. 47944, Mexican Application No. MX/a/2013/003748, issued by the Mexican Patent Office, dated Jun. 10, 2015.
Office Action from the Chilean Patent Office dated Jul. 22, 2016 for Chilean Patent Application No. 2013-00919.
Second Office Action for Chinese Patent Application No. 201180048571.7, State Intellectual Property Office of the P.R.C., Issue Date Apr. 3, 2015.

* cited by examiner

DISPENSING CLOSURE

CROSS-REFERENCE TO RELATED APPLICATIONS

This application claims the benefit of U.S. Provisional Application No. 61/982,338 filed on Apr. 22, 2014. This application is also a continuation-in-part (CIP) of U.S. patent application Ser. No. 14/589,596 filed on Jan. 5, 2015, now pending, which is a continuation of U.S. patent application Ser. No. 13/252,345 filed on Oct. 4, 2011, now U.S. Pat. No. 8,944,297. The Ser. No. 13/252,345 application claims the benefit of U.S. Provisional Application No. 61/391,101 filed on Oct. 8, 2010. The Ser. No. 13/252,345 application is also a continuation of US Design application No. 29/394,407 filed on Jun. 16, 2011, now U.S. Pat. No. D678,768. All of the applications referenced above are herein incorporated by reference

TECHNICAL FIELD

The present disclosure relates generally to a dispensing closure that is placed on a container for the dispensing of liquid contained therein, and more specifically to a dispensing closure where both an air opening and a liquid opening are sealable or otherwise closeable.

BACKGROUND

A pouring spout is typically attached to a container containing a liquid, for example a bottle, for the purpose of ensuring that the content of the container correctly flows to a target location, for example, a glass. Generally the pouring spout has a dispensing element that is used for the dispensing of the liquid and is generally formed as a tube in some form or shape. The pouring spout further contains an air tube that allows air to enter the container as liquid is dispensed, thereby ensuring uninterrupted flow of the liquid during pouring, as is well known in the art.

When dispensing beverages, a pouring spout is usually either assembled on the bottle or molded thereon for the purpose of making it easier for the user to dispense the beverage quickly and efficiently. Typical pouring spouts known in the art have a flip-top cover to enable closure of the pouring spout for storage purposes. However, such flip-tops increase the height of the containers, thereby increasing material usage and, consequently, costs of production.

It would therefore be advantageous to provide a solution that would overcome the deficiencies of the prior art by providing a dispenser with an effectively sealed pouring spout and an air tube of the pouring spout with a minimal effect on the height of a container.

SUMMARY

A summary of several example embodiments of the disclosure follows. This summary is provided for the convenience of the reader to provide a basic understanding of such embodiments and does not wholly define the breadth of the disclosure. This summary is not an extensive overview of all contemplated embodiments, and is intended to neither identify key or critical elements of all embodiments nor to delineate the scope of any or all aspects. Its sole purpose is to present some concepts of one or more embodiments in a simplified form as a prelude to the more detailed description that is presented later. For convenience, the term "some embodiments" may be used herein to refer to a single embodiment or multiple embodiments of the disclosure.

Some exemplary embodiments disclosed herein include a dispensing closure for covering an opening of a container including a liquid. The dispensing closure comprises an engagement element, wherein the engagement element fits over the opening of the container, the engagement element defining a pouring orifice for allowing pouring of the liquid, the pouring orifice having a side defining an air channel for allowing air to flow into the container when liquid during the pouring the engagement element further comprising: outer walls; and a cap having a hollow including inner walls tightly conforming to the outer walls, a first orifice generally conforming in shape to the pouring orifice, and a second orifice generally conforming in shape to the air channel, wherein the cap is engaged with the engagement element, the cap having a first position about the engagement element where the first orifice is not aligned with the pouring orifice and the second orifice is not aligned with the air channel, the cap having a second position about the engagement element where the first orifice is aligned with the pouring orifice and the second orifice is aligned with the air channel, wherein the liquid cannot be poured when the cap is in the first position and the liquid can be poured when the cap is in the second position.

BRIEF DESCRIPTION OF THE DRAWINGS

The subject matter disclosed herein is particularly pointed out and distinctly claimed in the claims at the conclusion of the specification. The foregoing and other objects, features, and advantages of the disclosed embodiments will be apparent from the following detailed description taken in conjunction with the accompanying drawings.

DETAILED DESCRIPTION

Figure 1A:
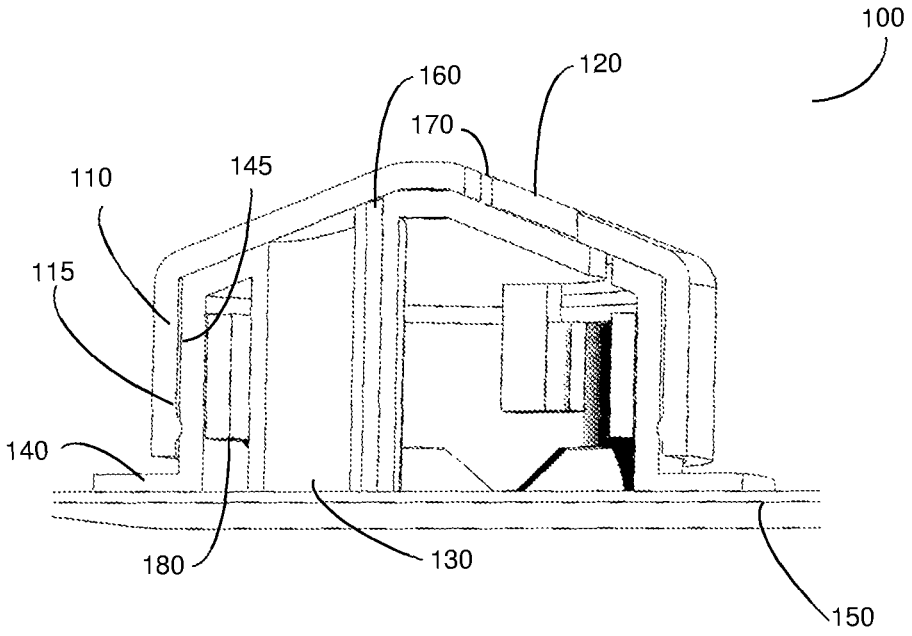
FIG. 1A is a schematic diagram illustrating a side view of a sealed dispensing closure constructed according to an embodiment.

It is important to note that the embodiments disclosed herein are only examples of the many advantageous uses of the innovative teachings herein. In general, statements made in the specification of the present application do not necessarily limit any of the various claimed embodiments. Moreover, some statements may apply to some inventive features but not to others. In general, unless otherwise indicated, singular elements may be in plural and vice versa with no loss of generality. In the drawings, like numerals refer to like parts through several views.

The various disclosed embodiments include a dispensing closure for mounting on a container containing liquid. The dispensing closure comprises an engagement element designed to fit over the opening of the container. The engagement element further comprises a pouring orifice to allow pouring of the liquid. The engagement element further comprises an air channel at a side of the pouring orifice to allow for air to flow into the container when the liquid is poured.

FIG. 1A shows an exemplary and non-limiting schematic diagram illustrating a side view of a dispensing closure 100 in a sealed configuration according to an embodiment. A cap 110 defines a first orifice 120 generally conforming in shape to a pouring orifice 130 of an engagement element 140. In the embodiment shown in FIG. 1A, the cap 110 is in a first position where the first orifice 120 of the cap 110 is not aligned with the corresponding pouring orifice 130 of the engagement element 140. The hollow of the cap 110 has inner walls 115 tightly conforming to outer walls 145 of the engagement element 140 at any rotational position of the cap 110 about the engagement element 140. The engagement element 140 is designed to fit over an opening of a container 150 containing liquids or to be assembled thereto.

The engagement element 140 further includes an air channel 160 which may be beside the pouring orifice 130. The air channel 160 allows air to flow into the container 150 when liquid is poured through the pouring orifice 130. The cap 110 further defines a second orifice 170 generally conforming in shape to the air channel 160. When the cap 110 is in the first position in which the first orifice 120 of the cap 110 is not aligned with the corresponding pouring orifice 130 of the engagement element 140, liquid cannot be poured out of the container through the dispensing closure 100.

Figure 1B:
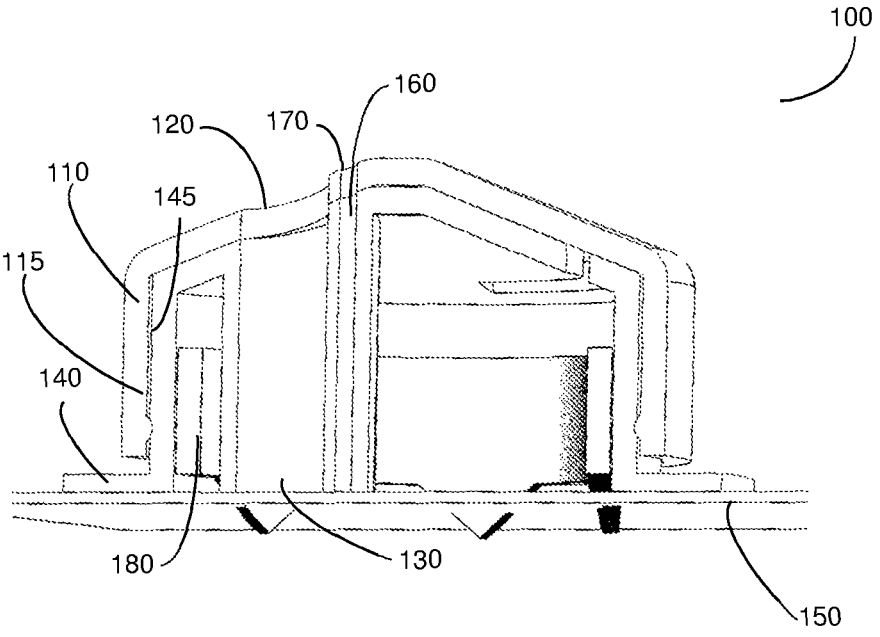
FIG. 1B is a schematic diagram illustrating a side view of an open dispensing closure constructed according to an embodiment.

FIG. 1B shows an exemplary and non-limiting schematic diagram illustrating a side view of the dispensing closure 100 in an open configuration according to an embodiment. In the embodiment shown in FIG. 1B, the cap 110 is in a second position where the first orifice 120 of the cap 110 is aligned with the corresponding pouring orifice 130 of the engagement element 140. As a result of this configuration, liquid can be poured out of the container through the dispensing closure 100. According to an embodiment, the position of the cap 110 can be changed from the first position where liquid cannot be poured out of the dispensing closure 100 to the second position where liquid can be poured out of the dispensing closure 100 by twisting of the cap 110. As a non-limiting example, the cap 110 may be changed from the first position to the second position upon twisting of the cap 110 by 180 degrees.

According to an embodiment, the container 150 comprises a foil (not shown) affixed to the top of the container 150. The foil may be used to preserve the freshness of the content of the container 150. In a further embodiment, the dispensing closure 100 may further comprise a threaded knife 180. During an initial use, the threaded knife 180 is pressed down upon twisting of the cap 110 from the first position to the second position, thereby perforating the foil and enabling pouring of the liquid from the container 150 thereafter.

A person skilled-in-the-art will readily note that other embodiments may be achieved without departing from the scope of the disclosure. For example and without limitation, other bases and/or engaging elements may be used to affix the dispensing closure 100 to the opening of the container 150.

In an embodiment, the dispensing closure 100 may further include an o-ring 190 for sealing the first orifice 120 and/or the second orifice 170. In the embodiment shown in Figs. 1A-1B, the o-ring 190 is for sealing the first orifice 120. In a further embodiment, the o-ring 190 is affixed to the cap 110. The o-ring 190 may be placed for, e.g., better sealing. In yet another embodiment, a locking mechanism (not shown) is used to lock the cap 110 in a depressed position when pressed downward. In that embodiment, another press releases the cap to its original locked position.

In an embodiment, the hollow of the cap may be coated with a sealing material layer 195 to ensure better sealing. Such a sealing material layer 195 may be, but is not limited to, rubber, Teflon®, or any other appropriate sealing material. In yet another embodiment, motion of the cap may be restricted to the first position, the second position, and positions between the first position and the second position. In an embodiment, a logo, an icon, a text, or the like can be printed, embossed, or otherwise affixed to, e.g., any side of the cap 110.

All examples and conditional language recited herein are intended for pedagogical purposes to aid the reader in understanding the principles of the disclosed embodiment and the concepts contributed by the inventor to furthering the art, and are to be construed as being without limitation to such specifically recited examples and conditions. Moreover, all statements herein reciting principles, aspects, and embodiments of the disclosed embodiments, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

What is claimed is:

1. A dispensing closure for covering an opening of a container including a liquid, comprising:

an engagement element, wherein the engagement element fits over the opening of the container, the engagement element defining a pouring orifice for allowing pouring of the liquid, the pouring orifice having a side defining an air channel for allowing air to flow into the container when liquid during the pouring the engagement element further comprising:

outer walls; and a cap having a hollow including inner walls tightly conforming to the outer walls, a first orifice generally conforming in shape to the pouring orifice, and a second orifice generally conforming in shape to the air channel, wherein the cap is engaged with the engagement element, the cap having a first position about the engagement element where the first orifice is not aligned with the pouring orifice and the second orifice is not aligned with the air channel, the cap having a second position about the engagement element where the first orifice is aligned with the pouring orifice and the second orifice is aligned with the air channel, wherein the liquid cannot be poured when the cap is in the first position and the liquid can be poured when the cap is in the second position.

2. The dispensing closure of claim 1, wherein the container includes a top, the dispensing closure further comprising:

a foil affixed to the top.

3. The dispensing closure of claim 2, further comprising:

a threaded knife, wherein the threaded knife perforates the foil when the cap is changed from the first position to the second position.

4. The dispensing closure of claim 1, further comprising:

an o-ring affixed to the cap for sealing at least one of: the first orifice, and the second orifice.

5. The dispensing closure of claim 1, further comprising a sealing material layer, wherein the hollow is coated with the sealing material layer.

6. The dispensing closure of claim 1, wherein motion of the cap about the engagement element is restricted to between the first position and the second position.

7. The dispensing closure of claim 1, wherein the cap further comprises at least one of: a printed logo on at least one side of the cap, a printed icon on at least one side of the cap, an embossed icon on at least one side of the cap, a printed text on at least one side of the cap, and an embossed text on at least one side of the cap.

* * * * *